US010486033B2

(12) United States Patent
Weilong

(10) Patent No.: US 10,486,033 B2
(45) Date of Patent: Nov. 26, 2019

(54) LIGHTED HOCKEY PUCK

(71) Applicant: Indian Industries, Inc., Evansville, IN (US)

(72) Inventor: Huang Weilong, Huizhou (CN)

(73) Assignee: Indian Industries, Inc., Evansville, IN (US)

( * ) Notice: Subject to any disclaimer, the term of this patent is extended or adjusted under 35 U.S.C. 154(b) by 0 days.

(21) Appl. No.: 15/404,603

(22) Filed: Jan. 12, 2017

(65) Prior Publication Data

US 2017/0232307 A1 Aug. 17, 2017

(30) Foreign Application Priority Data

Jan. 15, 2016 (CN) ..... 2016 2 0037456 U
Jan. 15, 2016 (CN) ..... 2016 3 0014343

(51) Int. Cl.

| | |
|---|---|
| ***A63B 43/06*** | (2006.01) |
| ***A63F 7/06*** | (2006.01) |
| ***F21V 23/02*** | (2006.01) |
| ***F21V 23/04*** | (2006.01) |
| ***F21V 33/00*** | (2006.01) |
| ***F21Y 115/10*** | (2016.01) |

(52) U.S. Cl.

CPC ..... *A63B 43/06* (2013.01); *A63F 7/066* (2013.01); *A63F 7/0632* (2013.01); *A63F 7/0664* (2013.01); *F21V 23/02* (2013.01); *F21V 23/04* (2013.01); *F21V 33/008* (2013.01); *F21Y 2115/10* (2016.08)

(58) Field of Classification Search

CPC ..... A63F 7/06; A63F 7/0632; A63F 7/066; A63F 7/40; A63F 2007/1068; A63B 43/06

See application file for complete search history.

(56) References Cited

U.S. PATENT DOCUMENTS

| | | | | | |
|---|---|---|---|---|---|
| 2,998,251 | A | * | 8/1961 | McShane | A63B 67/14 222/548 |
| 3,102,727 | A | | 9/1963 | Rice | |
| 3,462,149 | A | * | 8/1969 | Grusin | A63F 7/044 273/113 |
| D221,452 | S | * | 8/1971 | Swanberg | 473/588 |
| 3,927,885 | A | * | 12/1975 | Crossman | A63F 7/066 273/126 R |
| 4,183,536 | A | | 1/1980 | Platt | |
| 4,846,475 | A | | 7/1989 | Newcomb et al. | |
| 4,968,036 | A | * | 11/1990 | Von Der Mark | A63B 67/14 473/570 |

(Continued)

OTHER PUBLICATIONS

Green Biscuit Alien [online]; [Retrieved on Jan. 24, 2017]; Retrieved from http://greenbiscuit.com/product/allen/.

(Continued)

*Primary Examiner* — Melba Bumgarner
*Assistant Examiner* — Amir A Klayman
(74) *Attorney, Agent, or Firm* — Woodard, Emhardt, Henry, Reeves & Wagner LLP

(57) ABSTRACT

Certain embodiments of the present disclosure provide game pieces used with simulated hockey game tables, such as air hockey tables. The game pieces incorporate one or more lamps, such as LED lamps, to illuminate the game playing piece. In some embodiments, the body and periphery of the game playing piece are indirectly lit.

18 Claims, 4 Drawing Sheets

(56) References Cited

U.S. PATENT DOCUMENTS 5,695,420 A * 12/1997 Bellehumeur ..... A63B 67/14 473/588
5,697,858 A * 12/1997 Lekavich ..... A63B 67/14 473/588
5,720,651 A * 2/1998 Chien ..... A63B 43/06 415/115
6,059,676 A * 5/2000 Seymour ..... A63B 43/002 473/570
6,126,561 A * 10/2000 Mark ..... A63B 67/14 473/588
6,217,468 B1 * 4/2001 Goodwin ..... A63B 67/14 473/588
6,866,268 B2 * 3/2005 Christianson ..... A63B 65/10 273/398
7,621,833 B2 11/2009 Proulx et al.
7,815,532 B2 * 10/2010 Harpell ..... A63B 69/0026 473/588
7,900,921 B1 * 3/2011 Palmer ..... A63F 7/0664 273/108
D651,657 S * 1/2012 Laporte ..... D21/303
8,764,592 B2 * 7/2014 Vanderberg ..... A63B 67/14 473/588
9,463,360 B1 10/2016 Richard
2003/0119613 A1 * 6/2003 Samuel ..... A63B 43/00 473/588
2004/0164488 A1 8/2004 Fitzgerald
2005/0130775 A1 * 6/2005 Hylak ..... A63B 67/04 473/588
2007/0275801 A1 11/2007 Proulx et al.
2012/0025459 A1 * 2/2012 Vanderberg ..... A63F 7/0005 273/126 A
2012/0025460 A1 * 2/2012 Vanderberg ..... A63B 67/14 273/129 L
2012/0195052 A1 * 8/2012 Puskar-Pasewicz ..... H02G 3/14 362/341
2014/0309059 A1 * 10/2014 Minch ..... A63B 43/06 473/422
2017/0059286 A1 * 3/2017 D'Andrade ..... A63B 69/0024

OTHER PUBLICATIONS

The Comet Puck [online]; [Retrieved on Jan. 24, 2017]; Retrieved from www.thecometpuck.com.

* cited by examiner

LIGHTED HOCKEY PUCK

CROSS REFERENCE TO RELATED APPLICATIONS

This application claims priority to Chinese Patent No. ZL 2016 3 0014343.3 filed on Jan. 15, 2016, which is hereby incorporated by reference in its entirety.

FIELD OF THE DISCLOSURE

The disclosure is related to hockey game tables, particularly a lighted hockey puck for game tables.

BACKGROUND

People often enjoy physical exercises with the growing development of life standards. They may participate in a variety of sports, such as basketball, football, badminton, tennis, hockey, etc. Such sports are often simulated with game tables for use in homes, arcades or similar recreational settings. The present disclosure deals with hockey pucks or game pieces for games such as simulated hockey games, typically hockey game tables or games supported on flat elevated surfaces such as tables. Hockey puck pieces are typically used with hockey game tables with solid surfaces or with air hockey forced air style tables. The game pieces are normally propelled by the game players using handheld handles or mallets. It is desirable to have a game playing piece which enhances play.

Currently, solid single-color hockey pucks are most commonly used in the game table market. Red is a common color. Solid game table hockey pucks are usually made from injected plastics and are configured to float on an air cushion in an air hockey type game.

SUMMARY OF THE DISCLOSURE

In certain embodiments the disclosure provides a lighted hockey puck diversifying the functions of the hockey puck. An example lighted hockey puck includes a disc made of transparent materials. The disc is configured to float on an air cushion over an air hockey game table surface. For example, the disc may define a ring-shaped cavity on each side of the disc. A circuit board is internally mounted in the disc. The circuit board includes LED lamps, for example four lamps. A battery is engaged to the circuit board. The circuit board and lamps can be controlled with a switch.

Certain embodiments of the present disclosure provide game pieces used with simulated hockey games which are typically game tables or games supported on tables. The game pieces or pucks are generally substantially flat or planar and designed to slide or float over the game playing surface. In certain embodiments, the game pieces incorporate one or more lamps, such as LED lamps, to illuminate the game playing piece. In some embodiments, the body and periphery of the game playing piece are indirectly lit.

It is an object of certain embodiments of the present disclosure to provide a game piece.

Other objects and advantages of embodiments of the present disclosure will be apparent from the description, figures and claims.

DESCRIPTION OF ILLUSTRATED EMBODIMENTS

Figure 1:
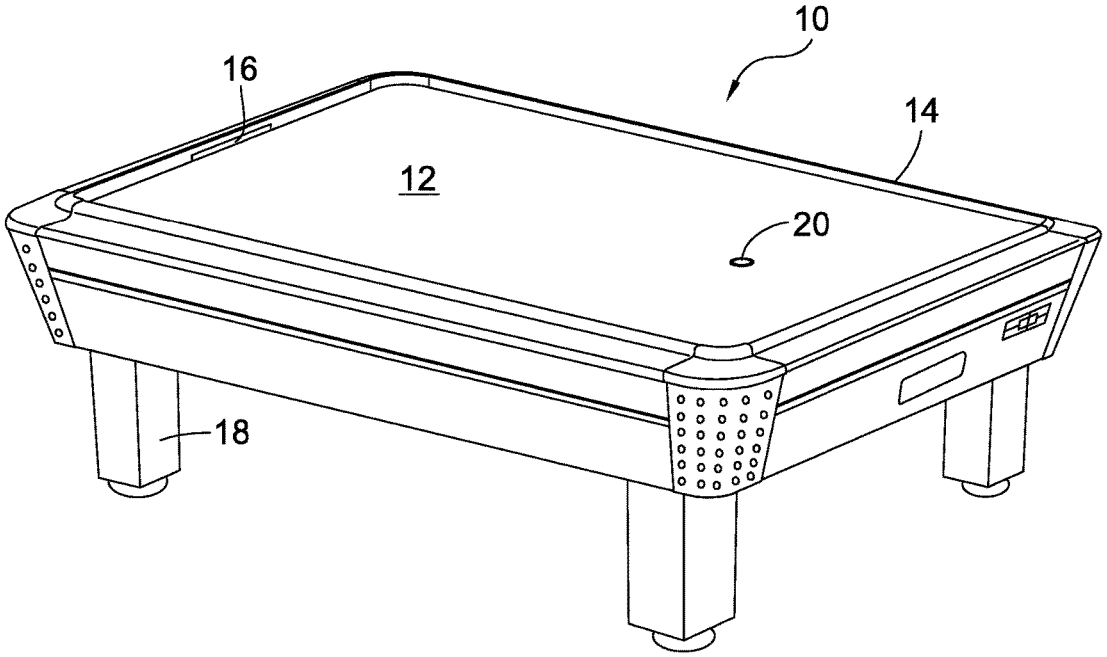
FIG. 1 illustrates an example embodiment of a lighted hockey puck on a hockey game table.
Figure 2:
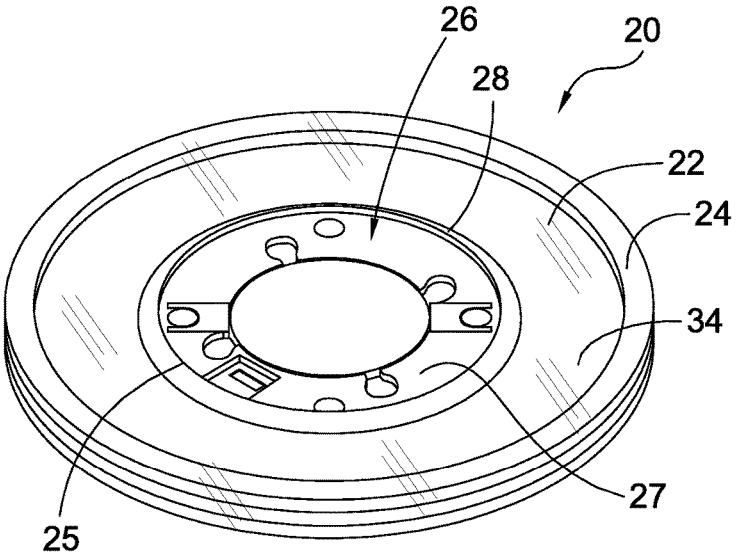
FIG. 2 is a perspective view of a lighted hockey puck.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein are contemplated as would normally occur to one skilled in the art to which the disclosure relates.

Certain embodiments of the present disclosure provide game pieces used with simulated hockey games which are typically game tables or games supported on tables. The game pieces or pucks are generally substantially flat or planar and designed to slide or float over the game playing surface. In certain embodiments, the game pieces incorporate one or more lamps, such as LED lamps, to illuminate the game playing piece. In some embodiments, the body and periphery of the game playing piece are indirectly lit.

As illustrated in FIG. 1, a conventional hockey game table 10 has a playing surface 12 defining a playing area, usually surrounded by a rail or railing 14 with sidewalls and endwalls. The table 10 includes a pair of goals or goal openings 16 in the opposing ends walls. The playing surface 12 is elevated by a support structure 18 such as table legs or one or more pedestals. The playing surface 12 is typically substantially flat. In some games, the surface is solid and polished to minimize friction between the game piece and the playing surface. In air hockey style games, the surface includes perforations or an array of spaced openings. A concealed air pump directs air which is distributed through internal channels and forced upward through the perforations. The expelled air forms air jets which create an air cushion upon which the game piece travels or glides. The game pieces 20 of the present disclosure are usable with various types of hockey game tables.

Most commonly used hockey game pieces have a circular or disc shaped profile; however, profiles in various geometric shape may be used, for example triangles, squares, rectangles, pentagons and hexagons. In one option, the corners of certain profiles are chamfered or rounded to enhance game play and to minimize stresses on sharp corners. Separately, optionally the peripheral edge or edges wrapping from the top or bottom to the outside face of the game piece include a slight radius to minimize material stresses, such as burrs or scratches, and to enhance game play. A typical circular profile is illustrated for reference. The present disclosure is not limited to one geometric profile.

Top, bottom, face and vertical references herein are from the perspective of a substantially planar game piece parallel to a game playing surface. Generally the bottom of the game piece is closest to the game playing surface, with the game piece having a height rising to a top surface parallel to and opposite the bottom surface. Top and bottom references herein are considered relative and may change if the game piece is flipped over.

FIGS. 2-7 illustrate an example embodiment of a game piece which is a lighted hockey puck 20. The body of puck 20 is formed of a transparent or translucent light transmissive plastic material. The body of puck 20 may be formed as one piece or alternately can be multiple assembled pieces, for example two disc portions which are secured together. For example the body piece(s) may by injection molded. The transparent or translucent plastic material is light permeable and transmits light. As illustrated, puck 20 is substantially planar with a central planar portion 22, often with a peripheral lip 24 which protrudes upward and downward on the upper and lower sides from the central planar portion 22. Puck 20 is typically symmetric and reversible and is operable for game play with either face facing downward.

Preferably the puck 20 has an industry standard size and weight, but variations in size and weight will be understood by those of skill in the art. For purposes of illustration, non-limiting dimensions are described. For example, in one embodiment of a hockey puck for a forced air table, the game piece has a weight of approximately 0.5 ounces. The typical hockey game piece for a home game table has an outer diameter or major axis of approximately 2.5 inches. In an alternate embodiment, an industry standard size uses a commercial game table piece with a diameter of approximately 3.5 inches, with the sizes of the components scaled appropriately. The puck may have a height between approximately ¼" and 3⁄16" between the top and bottom faces. In a 2.5 inch puck, the lip portion 20 may have an inner diameter of approximately 2.15 inches, with a proportionate size in a 3.5" diameter puck.

The height difference between the lip portion 24 and the central planar portion 22 forms a volume defining a slight cavity or air well. For example, central planar portion 22 may be spaced to form an approximately 0.020-0.030" deep well from the top or bottom face. When puck 20 rests on game playing surface 12 the contact area is limited to the upper or lower face of lip portion 24. When floating on an air cushion, the lip portion and cavity assist in supporting the puck on an air cushion providing aerodynamic performance.

Lip portion 24, shown in a ring style, typically includes an outside, typically smooth perimeter face, and has symmetric, preferably polished or smooth, top and bottom faces. Generally the top and bottom faces of the entire puck 20 are smooth and symmetric.

Center portion 25 of central planar portion 22 defines an internal cavity 26. Cavity 26 includes a bottom 27, a surrounding peripheral wall 28 and an open top. Cavity 26 is illustrated as circular, although other shapes may be used. The top of cavity 26 can be closed with a cover 30, which can be fastened in place, for example with screws. Alternately a snap-fit, threaded or tab-in-slot, adhesive or other fastening arrangement for the cover 30 can be used. In some embodiments cover 30 is removable to allow access to cavity 26, for example to allow the battery to be replaced.

A circuit board 40 is arranged in cavity 26. Cover 30 may be the back of circuit board 40. A battery 50 is arranged in cavity 26 and operably connected to circuit board 40. A spring piece 52 may be placed between cavity bottom 27 and battery 50 and used to bias the battery 50 into solid contact with circuit board 40. Portions of spring 52 may function as electrical contacts for one terminal of battery 50 and extend to positions offset from battery 50 to engage corresponding contacts on circuit board 40.

Circuit board 40 includes one or more LED lamps 44. In alternatives other types of lamps can be used. The illustrated embodiment includes four LED lamp locations equally spaced around the perimeter of circuit board 40, yet more or fewer lamps 44 can be used as desired. In certain embodiments the lamps 44 are colored to provide specific light colors. Preferably, the mass of the components within cavity 26 is distributed to not affect the center of gravity of puck 20.

The circuit board 40, lamps 44 and battery 50 are enclosed and protected within cavity 26. All or portions of the peripheral wall 28 of cavity 26 are transparent or translucent and co-planar with central planar portion 22. When lamps 44 are illuminated, the transparent material of the cavity peripheral wall radially transmits light from lamps 44 to the central planar portion 22 and lip portion 24 to create internal reflections, illuminating the central planar portion 22 and lip portion 24.

Figure 3:
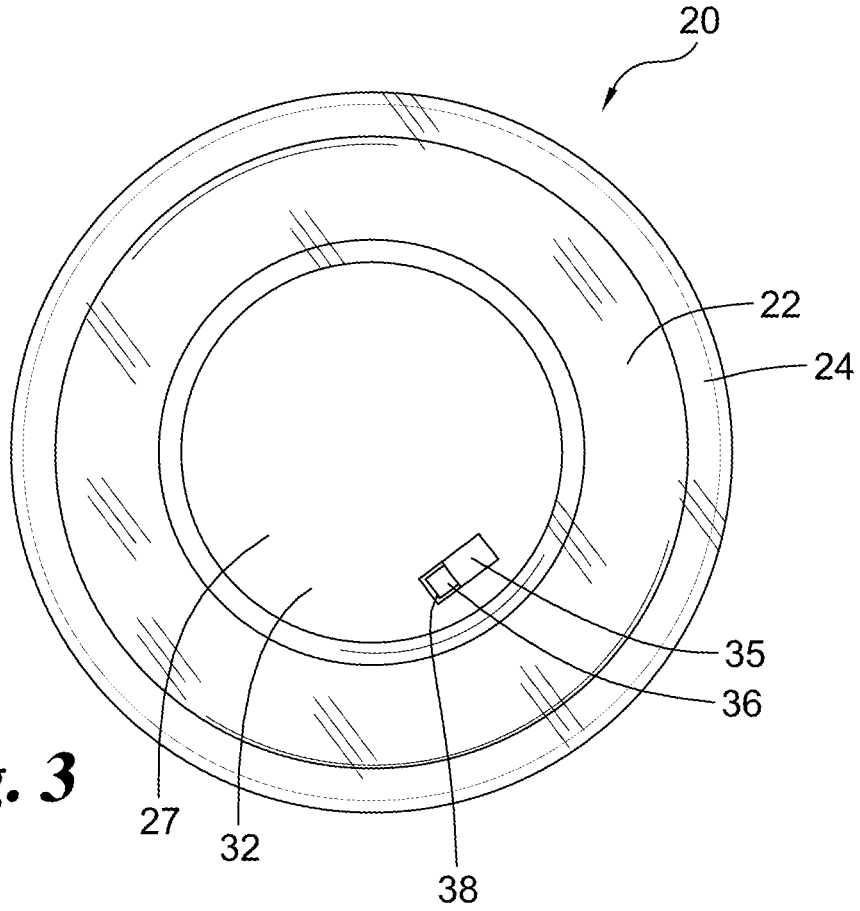
FIG. 3 illustrates a bottom view of the embodiment of FIG. 2.
Figure 4:
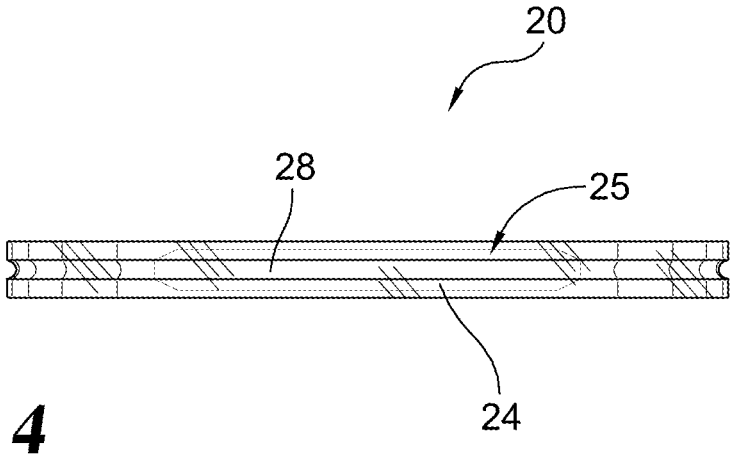
FIG. 4 illustrates a side view of the embodiment of FIG. 2.
Figure 5:
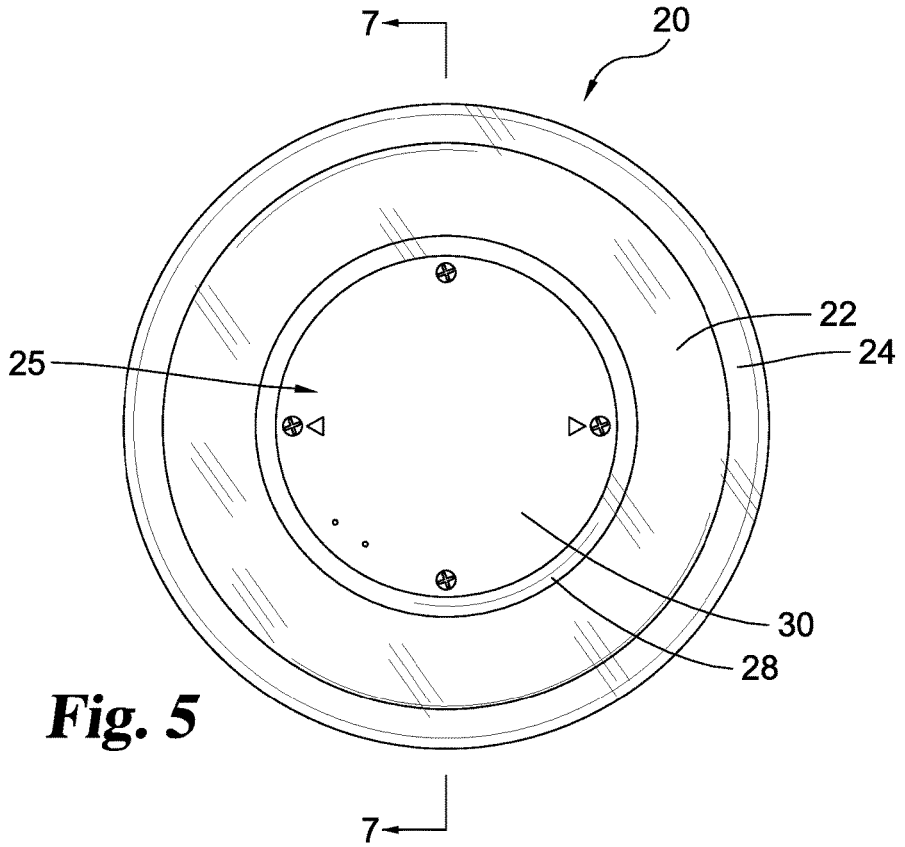
FIG. 5 illustrates a top view of the embodiment of FIG. 2.
Figure 6:
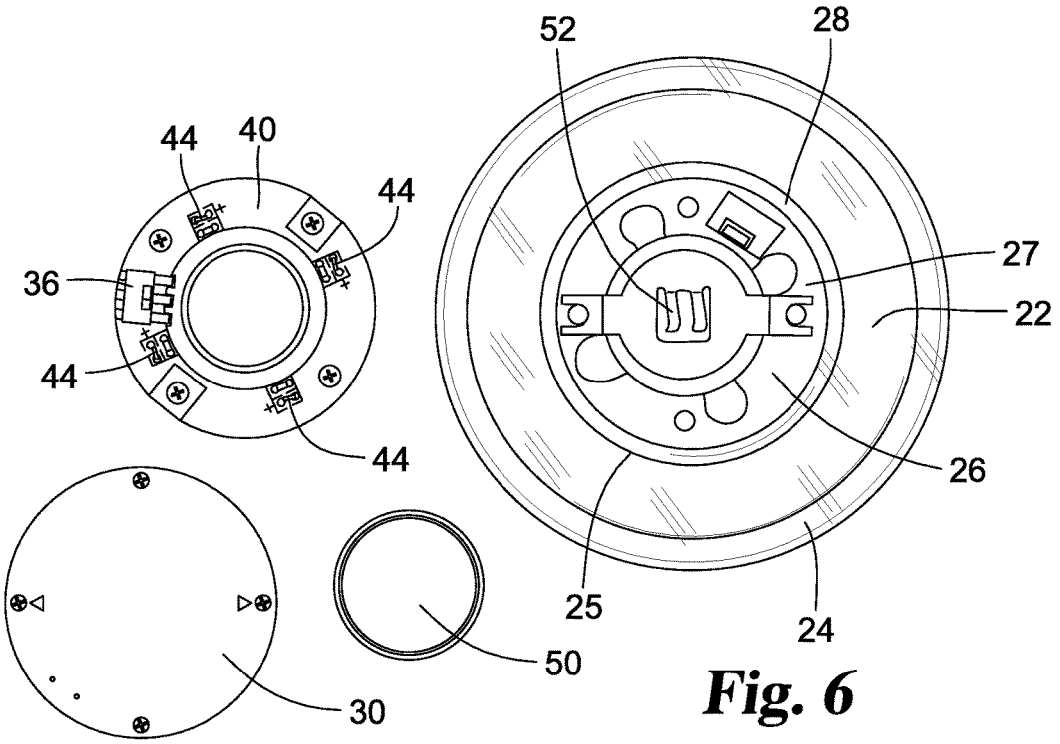
FIG. 6 illustrates a disassembled view of the embodiment of FIG. 2.
Figure 7:
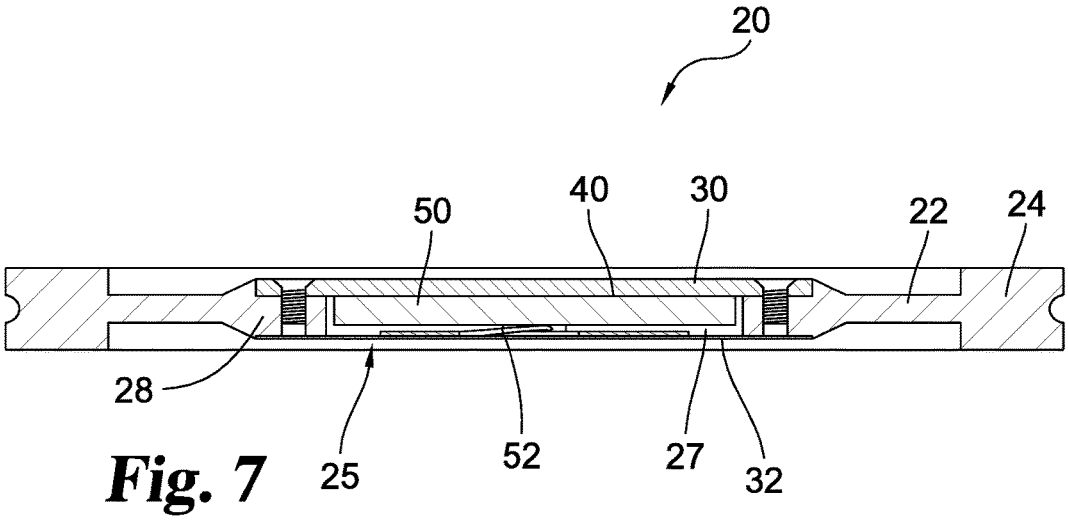
FIG. 7 illustrates a cross-sectional view of the embodiment of FIG. 2.

In some embodiments, the bottom 27 and cover 30 for cavity 26 are opaque and either block or substantially limit light from lamps 44 from being transmitted through the bottom 27 and cover 30. This limits the light perceived by users to indirect lighting effects rather than direct viewing of lamps 44. For example this may assist in low-light situations by minimizing the contrast and/or brightness of viewing lamps 44 directly. The opacity may be provided by light blocking materials or colors integrally formed with cavity 26 or with interior or exterior sticker or decals applied over one or both of the cover 30 and the cavity bottom 27. FIG. 3 illustrates a decal 32 applied over bottom 27. In certain options, the labels or decals are decorated with colors, graphics, information, team logos or for aesthetics. In other embodiments, the bottom 27 and cover 30 of cavity 26 may be transparent or translucent.

Optionally, the center portion 25 may slightly protrude in height on the upper and lower sides from the central planar portion 22, preferably with a height less than the perimeter lip portion 24. Center portion 25 is illustrated as circular, but optionally may be other geometric shapes. The volume between center portion 25 and lip portion 24 defines a shaped slot or air well 34 on each side of puck 20. In a disc shaped puck 20 the air well 34 is partially ring shaped around central portion 25.

A switch 36 is operably connected with the circuit board 40 and controls illumination of the lamps 44. Switch 36 includes a control tab 38 which extends through a slot 35 defined in central portion 25 to make it externally accessible. The slot 35 may extend from the bottom 27 of cavity 26 to the exterior surface of the center portion 25. A sticker or decal 32 covering the cavity bottom may include a defined slot to accommodate switch 36. A user can operate switch 36 to turn the circuit board on and off. Control tab 38 may be substantially flush with the outer surface of center portion 25 or may protrude or be inset slightly. Preferably, the height of control tab 38 is less than the height of lip portion 24 so that the control tab 38 does not contact the game playing surface during play.

Circuit board 40 may be programmed with a simple on/off functionality for all of the lamps 44. In other embodiments, circuit board 40 may be programmed to blink or turn the lamps on and off in a desired pattern or randomly. The programming may control the lamps simultaneously or individually, for example sequentially or in a motion that appears to skip from one lamp to another. The programming may also control the timing between controlling actions of the lamps individually or together.

The lighted hockey puck 20 also provides improved aesthetics during use in lighted or low-light environments.

In certain environments, the hockey puck 20 appears as a transparent floating and/or glittering hockey puck.

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

What is claimed is:

1. A game piece for a table hockey game, comprising a body having a planar central body portion made of a light transmissive plastic and a peripheral lip made of a light transmissive plastic which protrudes upward and downward from the central planar portion wherein said body portion is designed to float on an air cushion over a simulated hockey game table surface projecting jets of forced air;

wherein the height difference between the peripheral lip and the central planar portion forms a volume defining an air well on a top side and a bottom side of said body to assist in supporting the body on the air cushion;

a center portion of said body defining an internal cavity having a bottom, a surrounding peripheral wall and an open top wherein said surrounding peripheral wall is spaced inward of said peripheral lip;

a circuit board arranged in the cavity;

at least one LED lamp which emits visual light arranged in the cavity and operably connected to said circuit board;

a battery arranged in the cavity and operably connected to said circuit board;

a cover configured to be selectively fastened to said body to enclose said circuit board, said at least one LED lamp and said battery within the internal cavity;

a switch operably connected with the circuit board, said switch including a control tab which extends through a slot in the center portion to make the control tab externally accessible.

2. The game piece of claim 1 comprising a plurality of LED lamps which emit visual light arranged in the cavity and operably connected to said circuit board.

3. The game piece of claim 1, wherein said cavity peripheral wall is transparent and co-planar with said central planar portion and enables said lamp to radially transmit light to illuminate said central planar portion and to illuminate said lip portion.

4. The game piece of claim 3, wherein said cavity bottom and cover are opaque and substantially block light from said lamp from being transmitted through the bottom and cover.

5. The game piece of claim 3, comprising an opaque sticker applied over said cavity bottom which substantially blocks light from said lamp from being transmitted through the bottom and cover.

6. The game piece of claim 5, where said opaque sticker is externally applied to said cavity bottom.

7. The game piece of claim 1, wherein said center portion protrudes in height on the top side and the bottom side from the central planar portion a height less than the perimeter lip.

8. The game piece of claim 7, wherein the air wells are ring shaped and extend around the center portion and between said center portion and said peripheral lip on the top side and the bottom side of said planar central body portion.

9. A game piece for a table hockey game, comprising a body having a planar central body portion and a peripheral lip which protrudes upward and downward from the central planar portion wherein said body portion is designed to float on an air cushion over a simulated hockey game table surface projecting jets of forced air;

wherein the height difference between the peripheral lip and the central planar portion forms a volume defining an air well on a top side and a bottom side of said body to assist in supporting the body on the air cushion;

wherein said body is made of a light transmissive material;

a center portion of said body defining an internal cavity having a bottom, a surrounding peripheral wall and an open top wherein said surrounding peripheral wall is spaced inward of said peripheral lip;

a circuit board arranged in the cavity;

at plurality of LED lamps arranged in the cavity and operably connected to said circuit board;

wherein said peripheral wall is transparent and coplanar with said central body portion to enable said lamps to radially transmit light to illuminate said central planar portion and to illuminate said lip portion;

a battery arranged in the cavity and operably connected to said circuit board;

a cover configured to be selectively fastened to said body to enclose said circuit board, said lamps and said battery within the internal cavity;

a switch operably connected with the circuit board, said switch including a control tab which extends through a slot in the center portion to make the control tab externally accessible.

10. The game piece of claim 9, wherein said cavity bottom and said cover are opaque and substantially block light from said lamps from being transmitted through the bottom and cover.

11. The game piece of claim 10, wherein said game piece has an outer diameter between approximately 2.5 and 3.5 inches and a height between approximately ¼" and 3/16".

12. The game piece of claim 9, comprising an opaque sticker applied over said cavity bottom which substantially blocks light from said lamp from being transmitted through the cavity bottom.

13. The game piece of claim 12, where said opaque sticker is applied to the exterior surface of said cavity bottom.

14. The game piece of claim 13, wherein said switch control tab has a height flush with the exterior surface of said cavity bottom.

15. A game piece and table hockey game, comprising a hockey game table with a playing surface defining a playing area surrounded by a rail, wherein said playing surface is elevated by a table support structure; wherein said playing surface includes a pattern of perforations;

an air pump configured to distribute air through internal channels to be delivered upward through the perforations;

a game piece body having a planar central body portion and a peripheral lip which protrudes upward and downward from the central planar portion wherein said body portion is configured to slide on an air cushion created by the air delivered through the perforations;

wherein the height difference between the peripheral lip and the central planar portion forms a volume defining an air well on a top side and a bottom side of said body;

wherein said body is made of a light transmissive material;

a center portion of said body defining an internal cavity having a bottom, a surrounding peripheral wall and an open top wherein said surrounding peripheral wall is spaced inward of said peripheral lip;

a circuit board arranged in the cavity;

a plurality of LED lamps arranged in the cavity and operably connected to said circuit board;

wherein said peripheral wall is transparent and coplanar with said central body portion to enable said lamps to radially transmit light to illuminate said central planar portion and to illuminate said lip portion;

a battery arranged in the cavity and operably connected to said circuit board;

a cover configured to be selectively fastened to said body to enclose said circuit board, said at least one lamp and said battery within the internal cavity;

a switch operably connected with the circuit board, said switch including a control tab which extends through a slot in the center portion to make the control tab externally accessible.

16. The game piece of claim 15, wherein said cavity bottom and said cover are opaque and substantially block light from said lamps from being transmitted through the bottom and cover.

17. The game piece of claim 15, wherein said game piece has an outer diameter between approximately 2.5 and 3.5 inches and a height between approximately ¼" and 3⁄16".

18. The game piece of claim 15, wherein said game piece body is made of a clear plastic.

* * * * *